US007196501B1

(12) United States Patent
Dunipace

(10) Patent No.: US 7,196,501 B1
(45) Date of Patent: Mar. 27, 2007

(54) LINEAR REGULATOR

(75) Inventor: Richard A. Dunipace, Highland Village, TX (US)

(73) Assignee: Intersil Americas Inc., Milpitas, CA (US)

( * ) Notice: Subject to any disclaimer, the term of this patent is extended or adjusted under 35 U.S.C. 154(b) by 0 days.

(21) Appl. No.: 11/269,052

(22) Filed: Nov. 8, 2005

(51) Int. Cl.
*G05F 1/00* (2006.01)

(52) U.S. Cl. ..... 323/273; 323/274; 323/270

(58) Field of Classification Search ..... 323/270, 323/271, 273, 274
See application file for complete search history.

(56) References Cited

U.S. PATENT DOCUMENTS

| | | | | |
|---|---|---|---|---|
| 4,928,056 | A | 5/1990 | Pease | |
| 5,414,340 | A | 5/1995 | Gannon | |
| 5,548,204 | A | 8/1996 | Armstrong, II | |
| 5,578,916 | A | 11/1996 | Muterspaugh | |
| 5,677,558 | A | 10/1997 | McGlinchey | |
| 5,894,243 | A | 4/1999 | Hwang | |
| 6,031,362 | A | 2/2000 | Bradley | |
| 6,046,577 | A | 4/2000 | Rincon-Mora et al. | |
| 6,188,211 | B1 | 2/2001 | Rincon-Mora et al. | |
| 6,229,292 | B1 | 5/2001 | Redl et al. | |
| 6,359,427 | B1 | 3/2002 | Edwards | |
| 6,518,737 | B1 | 2/2003 | Stanescu et al. | |
| 6,522,112 | B1 | 2/2003 | Schmoock et al. | |
| 6,693,410 | B1 * | 2/2004 | Terrien | 323/274 |
| 6,703,816 | B2 * | 3/2004 | Biagi et al. | 323/280 |
| 6,750,638 | B1 | 6/2004 | Gang | |
| 6,759,836 | B1 | 7/2004 | Black, Jr. | |
| 6,806,690 | B2 | 10/2004 | Xi | |
| 6,909,204 | B2 * | 6/2005 | Batey | 307/130 |
| 7,088,082 | B2 * | 8/2006 | Jung | 323/275 |
| 7,109,690 | B2 * | 9/2006 | Ke et al. | 323/273 |

* cited by examiner

*Primary Examiner*—Bao Q. Vu
(74) *Attorney, Agent, or Firm*—Gary R. Stanford

(57) ABSTRACT

A linear regulator having an input node receiving an unregulated voltage, an output node providing a regulated voltage, a voltage regulator, a bias circuit, and a current control device. The voltage regulator has an input terminal, a reference terminal, and an output terminal which forms the output node of the linear regulator circuit. The bias circuit has a first terminal coupled to the output terminal of the voltage regulator and a second terminal. The current control device has a first current electrode which forms the input node of the linear regulator circuit, a second current electrode coupled to the input of the voltage regulator, and a control electrode coupled to the second terminal of the bias circuit. The bias circuit develops a voltage sufficient to drive the control terminal of the current control device and to operate the voltage regulator.

20 Claims, 3 Drawing Sheets

LINEAR REGULATOR

BACKGROUND OF THE INVENTION

1. Field of the Invention

The present invention relates to linear regulators, and more particularly to a linear regulator that has improved power supply rejection ratio, voltage regulation, power dissipation, and high voltage tolerance and which reduces input filter capacitor requirements.

2. Description of Related Art

Linear regulators are used in many electronic devices and applications for converting an unregulated input voltage to a regulated output voltage. A regulator is intended to hold its output voltage at a design value or within a predetermined voltage range regardless of changes in load current or input voltage. A 3-terminal regulator, which includes an input pin, an output pin and an adjust or ground pin, is a relatively simple and inexpensive realization of a linear regulator typically implemented on a separate chip or integrated circuit (IC). In the typical 3-terminal regulator configuration, a pass transistor is used to control the amount of conduction between the input and output of the regulator based upon a control voltage applied to the pass transistor. An amplifier circuit, such as an operational amplifier or the like, compares the regulator output voltage with a reference signal and adjusts the conduction of the pass device to regulate the output voltage to a predetermined voltage level. Several types of pass transistors can be employed depending upon the desired characteristics of the regulator, such as a PNP bipolar-junction transistor (BJT), or a P-channel metal-oxide semiconductor, field-effect transistor (MOSFET) for low voltage dropout applications, or an NPN Darlington pair driven by a PNP BJT (for standard configurations), or an NPN/PNP BJT pair (for quasi-low dropout voltage applications, etc.

There are several important specifications that exist for any linear regulator configuration. One specification is power supply rejection ratio (PSRR), which refers to the ratio of the change at the output of the regulator relative to the disturbance at the input that caused it. It is desired to have a relatively high PSRR to reduce input voltage supply disturbances as much as possible at the output, particularly input voltage ripple. Another specification is voltage regulation, which refers to the relative change of the output voltage in response to changes in output current or load transients. The output voltage of a regulator may change significantly in response to a significant load or input transient, whereas it is desired to improve regulation and provide greater output stability and regulated voltage accuracy in response to load or input transients. Another specification is the maximum input voltage rating of the regulator. The higher the voltage rating, the greater the applications to which the regulator might be employed thus giving it a larger potential market. An important concern in many applications is the power dissipation in the regulator itself. It is desired to maximize efficiency by minimizing power dissipation in the regulator itself while transferring input power to output power. Dropout voltage input-to-output is an important specification in this circumstance. Dropout is the minimum operating voltage of the regulator input-to-output. Regulators implemented according to low-drop-out (LDO) configurations focus on minimizing drop-out voltage.

SUMMARY OF THE INVENTION

A linear regulator circuit according to an embodiment of the present invention has an input node receiving an unregulated voltage and an output node providing a regulated voltage. The linear regulator circuit includes a voltage regulator, a bias circuit, and a current control device. The voltage regulator has an input terminal, a reference terminal, and an output terminal that forms the output node of the linear regulator circuit. The bias circuit has a first terminal coupled to the output terminal of the voltage regulator and a second terminal that is coupled to the control terminal of the current control device. The current control device has a first current electrode which forms the input node of the linear regulator circuit, a second current electrode coupled to the input of the voltage regulator, and a control electrode coupled to the second terminal of the bias circuit. The bias circuit develops a voltage sufficient to drive the control terminal of the current control device and to operate the voltage regulator.

In one embodiment, the current control device is implemented as an NPN bipolar junction transistor (BJT) having a collector electrode forming the input node of the linear regulator circuit, an emitter electrode coupled to the input of the voltage regulator, and a base electrode coupled to the second terminal of the bias circuit. A first capacitor may be coupled between the input and reference terminals of the voltage regulator and a second capacitor may be coupled between the output and reference terminals of the voltage regulator. The voltage regulator may be implemented as known to those skilled in the art, such as an LDO or non-LDO 3-terminal regulator or the like.

The bias circuit may include a bias device and a current source. The bias device has a first terminal coupled to the output terminal of the voltage regulator and a second terminal coupled to the control electrode of the current control device. The current source has an input coupled to the first current electrode of the current control device and an output coupled to the second terminal of the bias device. A capacitor may be coupled between the first and second terminals of the bias device.

In the bias device and current source embodiment, the bias device may be implemented as a Zener diode, one or more diodes coupled in series, at least one light emitting diode, or any other bias device which develops sufficient voltage while receiving current from the current source. The current source may be implemented with a PNP BJT having its collector electrode coupled to the second terminal of the bias device, at least one first resistor having a first end coupled to the emitter electrode of the PNP BJT and a second end, a Zener diode and a second resistor. The Zener diode has an anode coupled to the base electrode of the PNP BJT and a cathode coupled to the second end of the first resistor. The second resistor has a first end coupled to the anode of the Zener diode and a second end coupled to the reference terminal of the voltage regulator. A second Zener diode may be included having an anode coupled to the cathode of the first Zener diode and a cathode coupled to the first current electrode of the current control device.

A circuit is disclosed for improving operation of a linear regulator, having an input terminal, an output terminal, and a reference terminal. The circuit includes an input node, a transistor, a bias circuit, and first and second capacitors. The transistor has a first current electrode coupled to the input node, a second current electrode for coupling to the input terminal of the linear regulator, and a control electrode. The bias circuit has a first terminal for coupling to the output terminal of the linear regulator and a second terminal coupled to the control electrode of the transistor. The first capacitor is for coupling between the input and reference terminals of the linear regulator, and the second capacitor is for coupling between the output and reference terminals of the linear regulator. The bias circuit develops a voltage sufficient to drive the control terminal of the transistor and to operate the linear regulator. The bias circuit may be a battery, a bias device and a current source, a floating power supply, a charge pump, or any combination thereof. The transistor may be implemented as a BJT or FET or any other suitable current controlled device.

BRIEF DESCRIPTION OF THE DRAWINGS

The benefits, features, and advantages of the present invention will become better understood with regard to the following description, and accompanying drawings where.

DETAILED DESCRIPTION

The following description is presented to enable one of ordinary skill in the art to make and use the present invention as provided within the context of a particular application and its requirements. Various modifications to the preferred embodiment will, however, be apparent to one skilled in the art, and the general principles defined herein may be applied to other embodiments. Therefore, the present invention is not intended to be limited to the particular embodiments shown and described herein, but is to be accorded the widest scope consistent with the principles and novel features herein disclosed.

Figure 1:
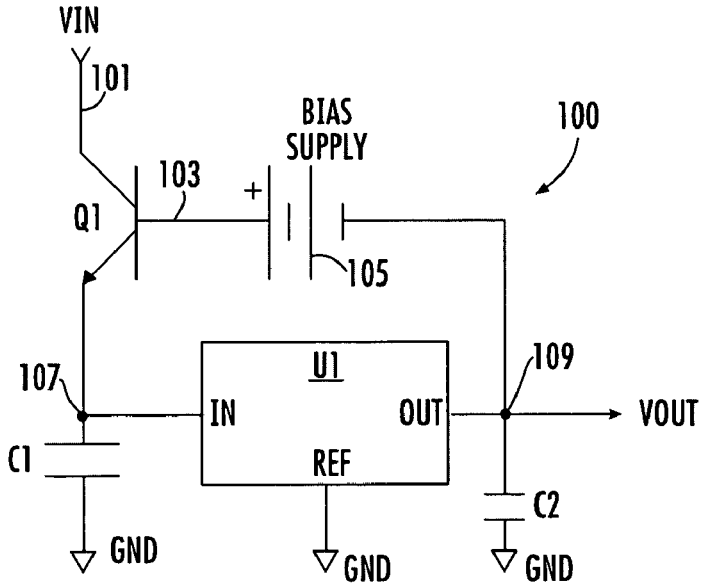
FIG. 1 is simplified schematic and block diagram of a linear regulator implemented according to an exemplary embodiment of the present invention.

FIG. 1 is schematic and block diagram of a linear regulator 100 implemented according to an exemplary embodiment of the present invention. An input voltage VIN is provided via an input node 101 to the collector of an external pass transistor Q1, which is shown as an NPN bipolar junction transistor (BJT). The base of Q1 is coupled to a bias node 103, which is coupled to the positive terminal of a bias circuit 105, shown implemented as a battery. The emitter of Q1 is coupled to a node 107, which is coupled to one end of an input capacitor C1 and to an input terminal of a voltage regulator U1. The other end of the capacitor C1 is coupled to ground (GND). The voltage regulator U1 includes an adjust or reference terminal coupled to GND. The negative terminal of the bias circuit 105 is coupled to an output node 109, to an output terminal of the voltage regulator U1 and to one end of an output capacitor C2. The other end of capacitor C2 is coupled to GND. The output node 109 develops an output voltage VOUT. In the embodiment illustrated, the voltage regulator U1 is a 3-terminal linear regulator and the bias circuit 105 is a battery.

The input voltage VIN is an unregulated DC voltage. The voltage at the input terminal of the voltage regulator U1 at node 107 is equal to the voltage at the output node 109 plus the voltage of the bias circuit 105 minus the emitter-base junction voltage of Q1. The emitter-base junction voltage of a BJT is typically about 0.7 Volts (V). In this manner, the voltage applied across the voltage regulator U1 is generally fixed and the voltage of the bias circuit 105 is designed to maintain the emitter-base junction voltage of Q1 to its fully operating value and to develop the necessary voltage at node 107 to keep the voltage regulator U1 from falling out of regulation. In one embodiment for an LDO voltage regulator U1, the voltage applied to the input terminal of the voltage regulator U1 is approximately 1V above the regulated voltage level of VOUT. The combination of the bias circuit 105 and the pass transistor Q1 pre-regulates the input terminal of the voltage regulator U1 and tracks the output voltage VOUT at node 109. The voltage regulator U1 operates according to its designed function, except that the external pass device Q1 improves the ripple rejection of voltage regulator U1 by approximately 30–40 decibels (dB), reduces the power dissipation in U1 to allow a smaller package (if implemented as an IC), and shields the voltage regulator U1 from high voltage levels of VIN. The voltage across the voltage regulator U1 remains constant even during current limit, which reduces current limit power dissipation and allows non fold-back limiting to be employed to enhance stability. The linear regulator 100 exhibits relatively stable and predictable power dissipation across the voltage regulator U1 with varying loads applied to the output node 109.

Figure 2:
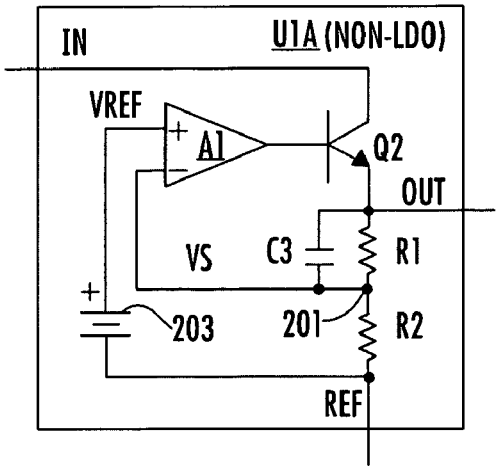
FIG. 2 (PRIOR ART)
FIG. 2 is a simplified schematic diagram of a first conventional embodiment of the voltage regulator of FIG. 1 as a non-LDO voltage regulator.

FIG. 2 is a simplified schematic diagram of a first conventional embodiment of the voltage regulator U1, which in this case is a non-low-drop-out (non-LDO) voltage regulator U1A. The input terminal IN is provided to the collector of an internal NPN pass BJT Q2, having its emitter coupled to the output terminal OUT of the voltage regulator U1A. A pair of internal voltage divider sense resistors R1 and R2 are coupled in series between the output terminal OUT and the reference terminal REF. The intermediate junction of the resistors R1 and R2 forms a sense node 201 developing a sense signal VS indicative of the voltage level of the OUT terminal. Node 201 is coupled to the inverting input of an internal error amplifier A1. A capacitor C3 is coupled in parallel with R1 between the OUT terminal and node 201. An internal voltage source 203 has its negative terminal coupled to REF and its positive terminal coupled to the non-inverting input of the error amplifier A1. The output of A1 drives the base of Q2. The amplifier A1 compares VS with VREF and drives Q2 to regulate the voltage level of the output terminal OUT at a predetermined voltage level as understood by those of ordinary skill in the art. Most regulators typically stop regulating if the voltage level of IN falls too close to the predetermined voltage level of OUT, or the dropout voltage. Non-LDO design regulators are not optimized to maintain regulation with a minimal input to output voltage. The voltage regulator U1A is a non-LDO design and stops regulating if the voltage level of IN falls too close to the predetermined voltage level of OUT. This means that the regulator was not designed to minimize the drop out of the regulator unlike an LDO type design. LDO designs focus on minimizing dropout voltage. In many applications, the lower the drop out voltage, the greater the overall input-output efficiency of the regulator. The voltage of the bias circuit 105 must be sufficiently high to ensure proper operation of U1A when used as the voltage regulator U1 of the linear regulator 100.

Figure 3:
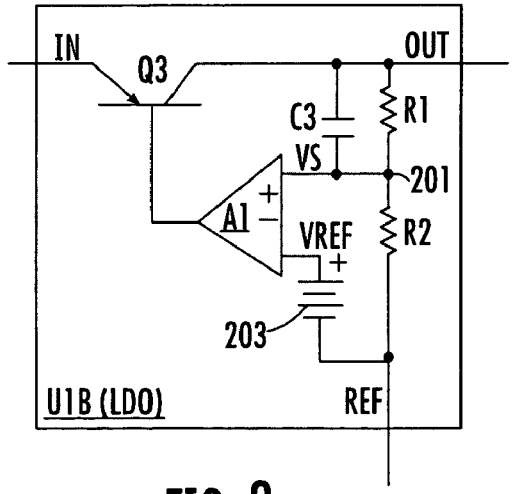
FIG. 3 (PRIOR ART)
FIG. 3 is a simplified schematic diagram of a second conventional embodiment of the voltage regulator of FIG. 1 as an LDO voltage regulator.

FIG. 3 is a simplified schematic diagram of a second conventional embodiment of the voltage regulator U1, which in this case is an LDO voltage regulator U1B. Similar components as those of the voltage regulator U1A assume identical reference numbers. For the voltage regulator U1B, the input terminal IN is provided to the emitter of an internal PNP pass BJT Q3, having its collector coupled to the output terminal OUT of the voltage regulator U1B. The internal voltage divider sense resistors R1 and R2 are coupled in series between the output terminal OUT and the reference terminal REF in a similar manner as in U1A. The intermediate junction of the resistors R1 and R2 forms the sense node 201 developing the sense signal VS indicative of the voltage level of the OUT terminal in a similar manner as in U1A. In this case, the sense node 201 is coupled to the non-inverting input of the internal error amplifier A1. The capacitor C3 is coupled in parallel with R1 between the OUT terminal and the node 201. The internal voltage source 203 has its negative terminal coupled to REF and its positive terminal coupled to the inverting input of the error amplifier A1. The output of A1 drives the base of Q3. The amplifier A1 compares VS with VREF and drives Q3 to regulate the voltage level of the output terminal OUT at a predetermined voltage level in similar manner. The voltage regulator U1B is LDO meaning that the voltage of the bias circuit 105 does not have to be significantly greater than the predetermined voltage level of OUT to ensure proper operation of U1B when used as the voltage regulator U1 of the linear regulator 100. A typical LDO has a drop out of less than 1V at full-rated output. Therefore, if the regulated output is 5V, the input terminal of the voltage regulator U1B can be as low as 6V while still functioning properly. Since the voltage regulator U1B is an LDO version, the voltage of the bias circuit 105 does not have to be substantially greater than the predetermined voltage level of OUT to ensure proper operation of U1B when used as the voltage regulator U1 of the linear regulator 100.

3-terminal regulators, including LDO regulators, typically have very limited rejection of fast transients on the input. This limits their performance and ability to reject noise, which is an important selection criteria of linear regulators. A sudden rise of VIN causes the base-emitter voltage of the internal pass transistor(s) (e.g., Q2 of U1A or Q3 of U1B) to increase regardless of the configuration of the internal error amplifier A1. Input voltage changes are sensed at the output of the internal pass transistor. Additionally, the internal error amplifier A1 takes time to sense the change on VIN and tends to hold the control voltage (base voltage) of the internal pass transistor constant during fast transients. Overall, fast transients tend to pass thru the voltage regulator U1 without much attenuation when operating alone without Q1 and the bias circuit 105. This means that the input voltage VIN must otherwise be sufficiently filtered to limit the noise and rise-time VIN transients. A non-LDO 3-terminal regulator, such as U1A, can be much better in this respect but still suffers performance issues due to the typical base junction impedance of the internal pass transistor since it tends to have high base-collector capacitance. So when a fast transient appears on VIN, it is coupled via the base-collector capacitance directly to the base electrode of the pass transistor thereby turning it on. The emitter electrode of the internal pass transistor is held relatively constant by the output capacitor C2, so that the pass transistor couples the fast transient directly from VIN to VOUT regardless of the state of the internal error amplifier A1.

The linear regulator 100 regulator operates substantially differently and has dramatically improved input fast transient and noise rejection. Fast transient rejection does not rely on the function of the LDO or non-LDO voltage regulator U1 but on the intrinsic characteristics of the external input pass transistor Q1. The base of the external pass transistor Q1 is coupled via a low-impedance bias circuit 105 to the output node 109, which is coupled to ground via the output capacitor C2. Any change of VIN is attenuated by the ratio of the base-collector capacitance of Q1 and the series of capacitance of the bias circuit 105 and the output capacitor C2. This is usually several orders of magnitude and can be optimized by selection of the output capacitor C2 and the design of the bias circuit 105. The emitter electrode of the external pass transistor Q1 is bypassed for fast transients by the input capacitor C1. Fast transients are coupled to the emitter electrode via the collector-emitter capacitance of the pass transistor Q1. The collector-emitter capacitance is typically orders of magnitude less than the capacitance of C1. Additionally, the ratio of the collector-emitter capacitance of Q1 and the input capacitance C1 can be adjusted via bypass component selection to be equal to the ratio of the collector-base capacitance of Q1 and the combination capacitance of the bias circuit 105 and the output capacitor C2. In this case, a fast input transient does not produce any significant change in the conductance of the pass transistor Q1. Fast transient attenuation is roughly equal to the collector-base versus output capacitance ratio or several orders of magnitude and be relatively frequency independent. In this manner, the linear regulator 100 regulator has significantly improved input fast transient and noise rejection as compared to conventional linear regulators.

Figure 4:
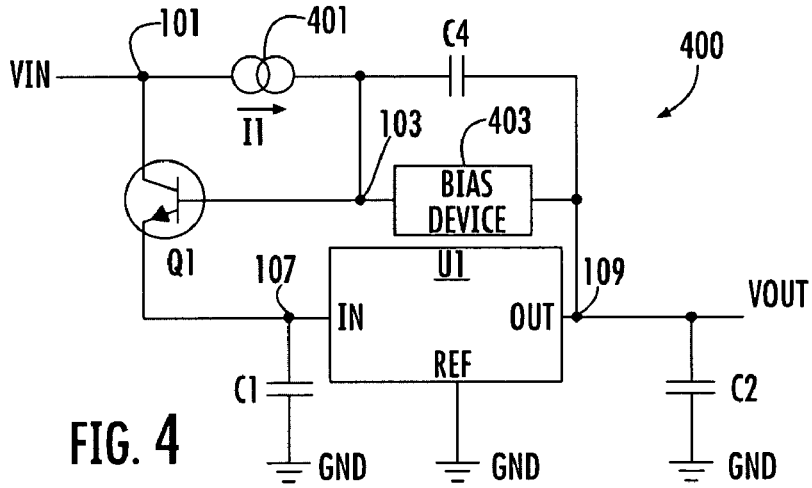
FIG. 4 is a schematic and block diagram of a linear regulator according to another exemplary embodiment of the present invention.

FIG. 4 is a schematic and block diagram of a linear regulator 400 according to another exemplary embodiment of the present invention. Similar components as those of the linear regulator 100 are shown with identical reference numbers. For the linear regulator 400, the transistor Q1, the capacitors C1 and C2, and the voltage regulator U1 are shown coupled to the input node 101, the output node 109, the bias node 103, and node 107 in substantially the same manner as for the linear regulator 100. In this case, the bias circuit 105 is configured as a current source 401, a bias device 403 and a capacitor C4. Although a battery provides the desired voltage bias function by itself and generally exhibits low impedance, a battery has a few disadvantages for an actual linear regulator implementation. A battery is relatively large and expensive and eventually discharges to a low voltage and thus is not the ideal circuit component. The current source 401 has an input coupled to node 101 and an output coupled to node 103 and sources a current I1. The bias device 403 has a negative terminal coupled to node 109 and a positive terminal coupled to node 103. The capacitor C4 is coupled between nodes 103 and 109. The bias device 403 performs a similar function of developing a bias voltage on bias node 103 relative to output node 109 to bias Q1 and the voltage regulator U1 in a similar manner as the bias circuit 105. The bias device 403 is generally a passive device, as further described below, and the current source 401 supplies current through the bias device 403 to enable it to develop the proper bias voltage level and to provide current to the base of Q1. The capacitor C4 substantially reduces the impedance between nodes 103 and 109 for improved operation.

Figure 5:
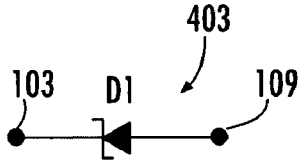
FIGS. 5, 6 and 7 are schematic diagrams illustrating various exemplary embodiments of the bias device of FIG. 4.

FIG. 5 is a schematic diagram illustrating a first exemplary embodiment of the bias device 403. In this case, the bias device 403 is implemented as a Zener diode D1 having its anode coupled to the output node 109 and its cathode coupled to the bias node 103. The voltage of the Zener diode D1 and the current I1 from the current source 401 are selected to drive the voltage of the bias node 103 to the appropriate level to enable the voltage regulator U1 to operate normally. For an LDO voltage regulator, an exemplary diode voltage of 1.6 V enables the voltage at node 107 to be approximately 1V above the voltage of VOUT assuming that the emitter-base voltage of Q1 is approximately 0.6V. The diode voltage is increased accordingly for a non-LDO configuration.

Figure 6:
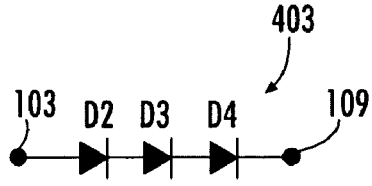

FIG. 6 is a schematic diagram of another exemplary embodiment of the bias device 403. In this case, the bias device 403 is implemented as a set of three diodes D2, D3, and D4 coupled in series between the nodes 103 and 109. As illustrated, the diode D2 has its anode coupled to node 103 and its cathode coupled to the anode of diode D3, which has its cathode couple to the anode of diode D4, which has its cathode coupled to node 109. Although three diodes D2–D4 are illustrated, any number of diodes (more or less and including a single diode if appropriate level of voltage is achieved) may be provided to develop the appropriate voltage level for the bias node 103 relative to the output node 109.

Figure 7:
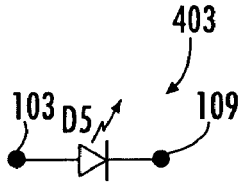

FIG. 7 is a schematic diagram of yet another exemplary embodiment of the bias device 403. In this case, the bias device 403 is implemented as a light-emitting diode (LED) D5 having its anode coupled to the node 103 and its cathode coupled to the output node 109. Depending upon the configuration of the voltage regulator U1, a single LED D5 may be sufficient to generate the sufficient voltage for the bias node 103. Any number of LEDs may be coupled in series to develop the appropriate voltage level for the bias node 103 relative to the output node 109.

Figure 8:
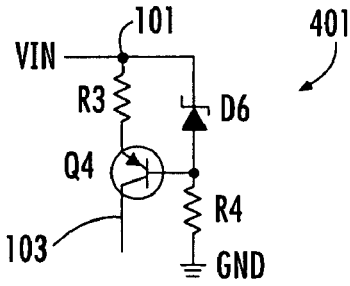
FIG. 8 is a schematic diagram of an exemplary embodiment of the current source of FIG. 4.

FIG. 8 is a schematic diagram of an exemplary embodiment of the current source 401, which includes a pair of resistors R3 and R4, a Zener diode D6, and a PNP BJT Q4. It is appreciated that alternative embodiments of the current source 401 are contemplated. The cathode of D6 is coupled to one end of the resistor R3 at the input node 101. The other end of the resistor R3 is coupled to the emitter electrode of Q4, having its base coupled to the anode of D6 and to one end of the resistor R4. The collector electrode of Q4 is coupled to node 103 and the other end of the resistor R4 is coupled to GND. In an exemplary prototype configuration, the current of the current source 401 is approximately 35 milliamps (mA), the DC gain of Q1 is 35, and a bias current of approximately 5 mA is provided to the bias device 403. The pass transistor Q1 is implemented as a BJT for convenience and simplicity. A suitable field-effect transistor (FET) (not shown) (including a MOSFET) may be used as the external pass device instead of a BJT, such as an N-channel FET having its gate coupled to the bias node 103, its source coupled to node 107 and its drain coupled to the input node 101. The gate-source voltage of a FET is typically greater than the base-emitter voltage of an NPN BJT, so that the voltage of the bias node 103 is increased accordingly to drive the gate electrode of the FET.

Figure 9:
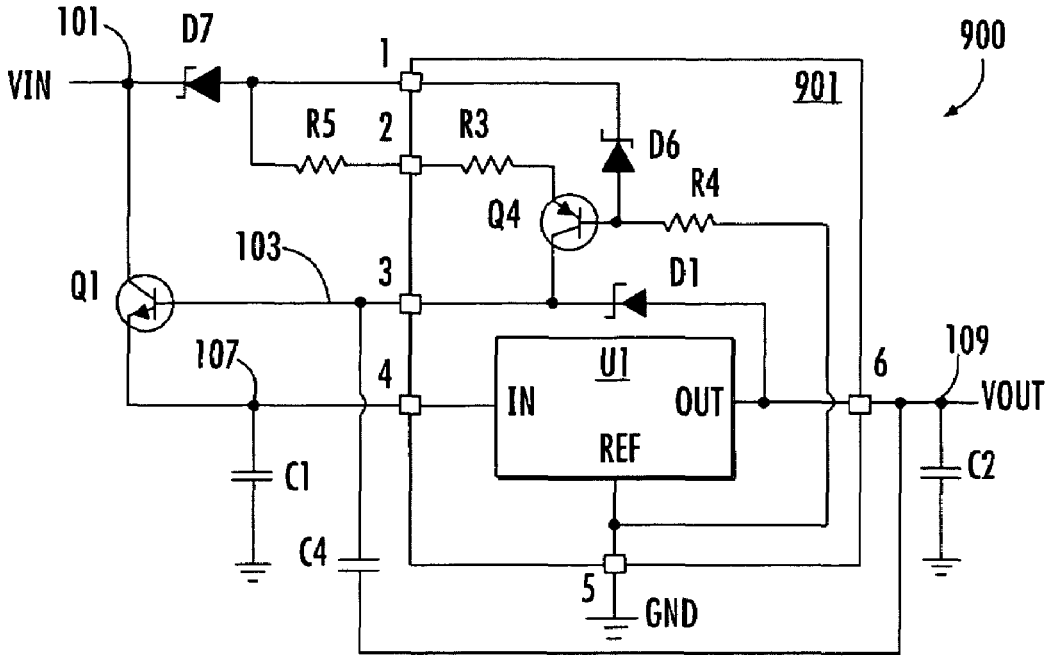
FIG. 9 is a schematic diagram of a linear regulator implemented according to another exemplary embodiment of the present invention in which a substantial portion of the linear regulator is provided on an integrated circuit.

FIG. 9 is a schematic diagram of a linear regulator 900 implemented according to another exemplary embodiment of the present invention in which a substantial portion of the linear regulator is provided on an integrated circuit (IC) 901. Similar components and elements as those of the linear regulator 100 (and/or 400) assume identical reference numerals. In this case, the components Q1, C1 and C2 are provided and coupled to nodes 101, 103, 107 and 109 in substantially the same manner as for the linear regulator 100. The resistors R3 and R4, the Zener diode D6 and the BJT Q4 of the current source 401 are included within the IC 901 and coupled mostly as shown FIG. 5 except that the cathode of D6 is not directly coupled to the resistor R3 within the IC 901. In this case, the cathode of D6 is coupled to a pin 1 of the IC 901 and its anode is coupled to the base electrode of Q4 and to one end of the resistor R4. The collector electrode of Q4 is coupled to a pin 3 of the IC 901 and its emitter electrode is coupled to one end of the resistor R3, having its other end coupled to a pin 2 of the IC 901. The other end of the resistor R4 is coupled to a pin 5 of the IC 901. The IC 901 also includes the Zener diode D1 for implementing the bias device 403, where the anode of D1 is coupled to a pin 6 of the IC 901 and its cathode is coupled the collector electrode of Q4 and to pin 3. The voltage regulator U1 is integrated within the IC 901 having its input coupled to a pin 4 of the IC 901, its output coupled to pin 6, and its reference terminal coupled to pin 5. Pin 3 is externally coupled to the bias node 103, pin 4 is externally coupled to the node 107, and pin 6 is externally coupled to the output node 109.

The cathode of D6 and the corresponding end of the resistor R3 of the current source 401 were shown coupled together at the input node 101 in FIG. 5. In the implementation of the IC 901, however, this connection is broken so that the cathode of D6 and the corresponding end of the resistor R3 may be coupled to separate pins 1 and 2. An external resistor R5 is coupled between pins 1 and 2, and an external Zener diode D7 has its anode coupled to pin 1 of the IC 901 and its cathode coupled to input node 101. R5 and D7 are optional. The Zener diode D7 enables the input voltage VIN to be higher than the fabrication process of the IC 901 might otherwise allow, such as in an automotive application. The Zener diode D7 also reduces the power dissipation of the internal current source 401. The resistor R5 is used to lower the current in the current source 401 for lower power applications. Either one of the Zener diode D7 and the resistor R5 may be omitted, or both may be omitted in which case the pins 1 and 2 of the IC 901 may be coupled together at the input node 101. The capacitor C4 may be integrated on the IC 901 and internally coupled between pins 3 and 6. Instead, as shown, the capacitor C4 is externally provided and coupled between pins 3 and 6 to enable a user to select its value for a particular configuration, or omit it altogether if desired.

Although the present invention has been described in considerable detail with reference to certain preferred versions thereof, other versions and variations are possible and contemplated. Those skilled in the art should appreciate that they can readily use the disclosed conception and specific embodiments as a basis for designing or modifying other structures for providing out the same purposes of the present invention without departing from the spirit and scope of the invention.

What is claimed is:

1. A linear regulator circuit having an input node receiving an unregulated voltage and an output node providing a regulated voltage, comprising:

a voltage regulator having an input terminal, a reference terminal, and an output terminal forming the output node of the linear regulator circuit;

a bias circuit having a first terminal coupled to said output terminal of said voltage regulator and a second terminal; and a current control device having a first current electrode forming the input node of the linear regulator circuit, a second current electrode coupled to said input of said voltage regulator, and a control electrode coupled to said second terminal of said bias circuit;

wherein said bias circuit develops a voltage sufficient to drive said control terminal of said current control device and to operate said voltage regulator.

2. The linear regulator circuit of claim 1, wherein said current control device comprises an NPN bipolar junction transistor having a collector electrode forming the input node of the linear regulator circuit, an emitter electrode coupled to said input of said voltage regulator, and a base electrode coupled to said second terminal of said bias circuit.

3. The linear regulator circuit of claim 1, wherein said bias circuit comprises:

a bias device having a first terminal coupled to said output terminal of said voltage regulator and a second terminal coupled to said control electrode of said current control device; and a current source having an input coupled to said first current electrode of said current control device and an output coupled to said second terminal of said bias device.

4. The linear regulator circuit of claim 3, further comprising a capacitor coupled between said first and second terminals of said bias device.

5. The linear regulator circuit of claim 3, wherein said bias device comprises a Zener diode having an anode coupled to said output terminal of said voltage regulator and a cathode coupled to said control electrode of said current control device.

6. The linear regulator circuit of claim 3, wherein said bias device comprises a plurality of diodes coupled in series having a cathode coupled to said output terminal of said voltage regulator and an anode coupled to said control electrode of said current control device.

7. The linear regulator circuit of claim 3, wherein said bias device comprises at least one light emitting diode having a cathode coupled to said output terminal of said voltage regulator and an anode coupled to said control electrode of said current control device.

8. The linear regulator circuit of claim 3, wherein said current source comprises:

a PNP bipolar junction transistor (BJT) having an emitter electrode, a base electrode, and a collector electrode coupled to said second terminal of said bias device;

at least one first resistor having a first end coupled to said emitter electrode of said PNP BJT and a second end;

a first Zener diode having an anode coupled to said base electrode of said PNP BJT and a cathode coupled to said second end of said at least one first resistor; and a second resistor having a first end coupled to said anode of said first Zener diode and a second end coupled to said reference terminal of said voltage regulator.

9. The linear regulator circuit of claim 8, further comprising a second Zener diode having an anode coupled to said cathode of said first Zener diode and a cathode coupled to said first current electrode of said current control device.

10. The linear regulator circuit of claim 3, wherein said current control device comprises an NPN bipolar transistor having a collector electrode coupled to said input of said current source, an emitter electrode coupled to said input of said voltage regulator, and a base electrode coupled to said output of said current source.

11. The linear regulator circuit of claim 1, further comprising a first capacitor coupled between said input and reference terminals of said voltage regulator and a second capacitor coupled between said output and reference terminals of said voltage regulator.

12. The linear regulator circuit of claim 1, wherein said voltage regulator comprises:

a pass device having a control electrode and having first and second current electrodes coupled between said input and output terminals of said voltage regulator;

a sense circuit coupled between said output and reference terminals of said voltage regulator and having a sense node providing a sense signal; and an error amplifier having a first input coupled to said sense node of said sense circuit, a second input receiving a reference voltage and an output coupled to said control electrode of said pass device.

13. The linear regulator circuit of claim 12, wherein:

said pass device comprises an NPN bipolar junction transistor having a collector electrode coupled to said input terminal of said voltage regulator, an emitter electrode coupled to said output terminal of said voltage regulator, and a base electrode coupled to said output of said error amplifier; and wherein first and second inputs of said error amplifier comprise inverting and non-inverting inputs, respectively.

14. The linear regulator circuit of claim 12, wherein:

said pass device comprises a PNP bipolar junction transistor having a collector electrode coupled to said output terminal of said voltage regulator, an emitter electrode coupled to said input terminal of said voltage regulator, and a base electrode coupled to said output of said error amplifier; and wherein first and second inputs of said error amplifier comprise non-inverting and inverting inputs, respectively.

15. A circuit for improving operation of a linear regulator, the linear regulator having an input terminal, an output terminal, and a reference terminal, the circuit comprising:

an input node;

a transistor having a first current electrode coupled to said input node, a second current electrode for coupling to the input terminal of the linear regulator, and a control electrode;

a bias circuit having a first terminal for coupling to the output terminal of the linear regulator and having a second terminal coupled to said control electrode of said transistor;

a first capacitor for coupling between the input and reference terminals of the linear regulator; and a second capacitor for coupling between the output and reference terminals of the linear regulator;

wherein said bias circuit develops a voltage sufficient to drive said control terminal of said transistor and to operate the linear regulator.

16. The circuit of claim 15, wherein said bias circuit comprises a battery.

17. The circuit of claim 15, wherein said transistor comprises an NPN bipolar junction transistor having a collector electrode coupled to said input node, an emitter electrode for coupling to the input terminal of the voltage regulator, and a base electrode coupled to said second terminal of said bias circuit.

18. The circuit of claim 15, wherein said bias circuit comprises:

a bias device having a first terminal for coupling to the output terminal of the regulator and having a second terminal; and a current source having an input coupled to said input node and an output coupled to said second terminal of said bias device.

19. The circuit of claim 18, wherein said bias device comprises a Zener diode.

20. The circuit of claim 18, wherein said current source comprises:

a first resistor having a first end for coupling to the reference terminal of the regulator and a second end;

a Zener diode having an anode coupled to said second end of said first resistor and a cathode;

a second resistor having a first end coupled to said cathode of said Zener diode and a second end; and a PNP bipolar junction transistor having an emitter electrode coupled to said second end of said second resistor, a base electrode coupled to said anode of said Zener diode, and a collector electrode coupled to said second terminal of said bias device.

* * * * *